US010658807B2

(12) United States Patent
Dai et al.

(10) Patent No.: US 10,658,807 B2
(45) Date of Patent: May 19, 2020

(54) TERMINAL BENDING TOOL

(71) Applicants: Tyco Electronics (Shanghai) Co. Ltd., Shanghai (CN); Shenzhen AMI Technology Co., Ltd, Guangdong (CN)

(72) Inventors: Zhiyong Dai, Shanghai (CN); Lvhai Hu, Shanghai (CN); Yingcong Deng, Shanghai (CN); Lei Zhou, Shanghai (CN); Yun Liu, Shanghai (CN); Qinglong Zeng, Guangdong (CN); Wei Kang, Guangdong (CN)

(73) Assignees: Tyco Electronics (Shanghai) Co. Ltd., Shanghai (CN); Shenzhen AMI Technology Co., Ltd., Shenzhen (CN)

( * ) Notice: Subject to any disclaimer, the term of this patent is extended or adjusted under 35 U.S.C. 154(b) by 274 days.

(21) Appl. No.: 15/606,056

(22) Filed: May 26, 2017

(65) Prior Publication Data

US 2017/0346251 A1 Nov. 30, 2017

(30) Foreign Application Priority Data

May 27, 2016 (CN) ..... 2016 2 0498336 U

(51) Int. Cl.

| | |
|---|---|
| ***H01R 43/04*** | (2006.01) |
| ***H01R 43/16*** | (2006.01) |
| ***H01R 12/72*** | (2011.01) |
| ***B21D 7/024*** | (2006.01) |

(52) U.S. Cl.

CPC ..... *H01R 43/04* (2013.01); *B21D 7/024* (2013.01); *H01R 43/16* (2013.01); *H01R 12/724* (2013.01)

(58) Field of Classification Search

CPC ..... H01R 43/04; H01R 43/16; H01R 43/048; H01R 43/0482; B21D 5/06; B21D 5/08; B21D 11/20; B21D 7/024; B21D 37/10; B21D 5/14; B21D 11/10; Y10T 29/53226; Y10T 29/53235; Y10T 29/5327

USPC ..... 72/75, 112

See application file for complete search history.

(56) References Cited

U.S. PATENT DOCUMENTS 5,827,077 A * 10/1998 Fukuda ..... H01R 12/716 439/79

2004/0185692 A1* 9/2004 Boonsue ..... H01R 12/721 439/79

FOREIGN PATENT DOCUMENTS

DE 102008051378 A1 * 4/2010 ..... B21D 11/10

OTHER PUBLICATIONS

Machine translation of DE 102008051378A1, Boegelein, pp. 1-23, translated on Apr. 22, 2019. (Year: 2019).*

* cited by examiner

*Primary Examiner* — Teresa M Ekiert

(74) *Attorney, Agent, or Firm* — Barley Snyder

(57) ABSTRACT

A terminal bending tool comprises a plate, a plurality of receiving grooves, and a plurality of rollers. The plate extends in a first horizontal direction. The receiving grooves are disposed in the plate in a row along the first horizontal direction. The rollers are pivotally mounted in the receiving grooves. A terminal is received and positioned in a first receiving groove and is in contact with an outer circumferential surface of a first roller. When the terminal bending tool is moved in a vertical direction perpendicular to the first horizontal direction, the first roller rotates and moves along a surface of the terminal while pressing and bending the terminal.

17 Claims, 6 Drawing Sheets

TERMINAL BENDING TOOL

CROSS-REFERENCE TO RELATED APPLICATION

This application claims the benefit of the filing date under 35 U.S.C. § 119(a)-(d) of Chinese Patent Application No. 201620498336.X, filed on May 27, 2016.

FIELD OF THE INVENTION

The present invention relates to a terminal bending tool and, more particularly, to a terminal bending tool capable of simultaneously bending a row of terminals.

BACKGROUND

During the manufacture of some known electrical connectors, it is necessary to bend a conductive terminal of the connector to a preset angle, for example, 90°. In the prior art, the conductive terminal is bent manually.

Manual bending requires bending each conductive terminal individually; a row of conductive terminals cannot be bent simultaneously, limiting bending efficiency. Furthermore, it is difficult to ensure bending accuracy using manual bending. Large errors occur in the bended position, degrading the bending accuracy of the conductive terminal, which complicates correctly mounting the conductive terminal onto a circuit board. In addition, during manual bending, a worker needs to clamp the conductive terminal with tools such as pliers, which creates scratches on a surface of the conductive terminals, degrading the quality of the conductive terminals.

SUMMARY

A terminal bending tool comprises a plate, a plurality of receiving grooves, and a plurality of rollers. The plate extends in a first horizontal direction. The receiving grooves are disposed in the plate in a row along the first horizontal direction. The rollers are pivotally mounted in the receiving grooves. A terminal is received and positioned in a first receiving groove and is in contact with an outer circumferential surface of a first roller. When the terminal bending tool is moved in a vertical direction perpendicular to the first horizontal direction, the first roller rotates and moves along a surface of the terminal while pressing and bending the terminal.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
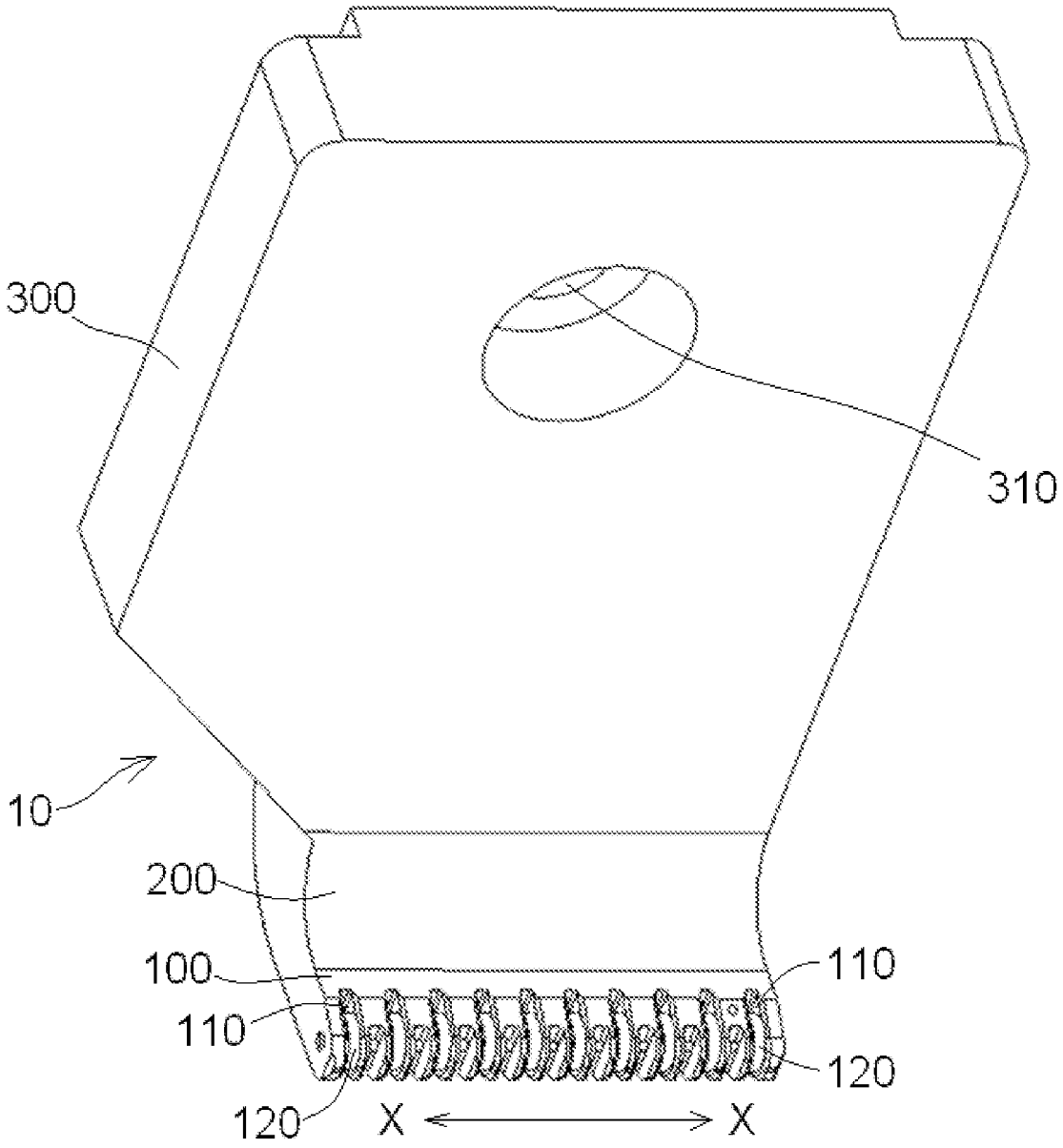
FIG. 1 is a perspective view of a terminal bending tool according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A terminal bending tool 10 according to the invention is shown in FIGS. 1-4. The terminal bending tool 10 has a plate 100, a plurality of receiving grooves 110, a plurality of rollers 120, a transition portion 200, and a mounting portion 300. The major components of the invention will now be described in greater detail.

Figure 2:
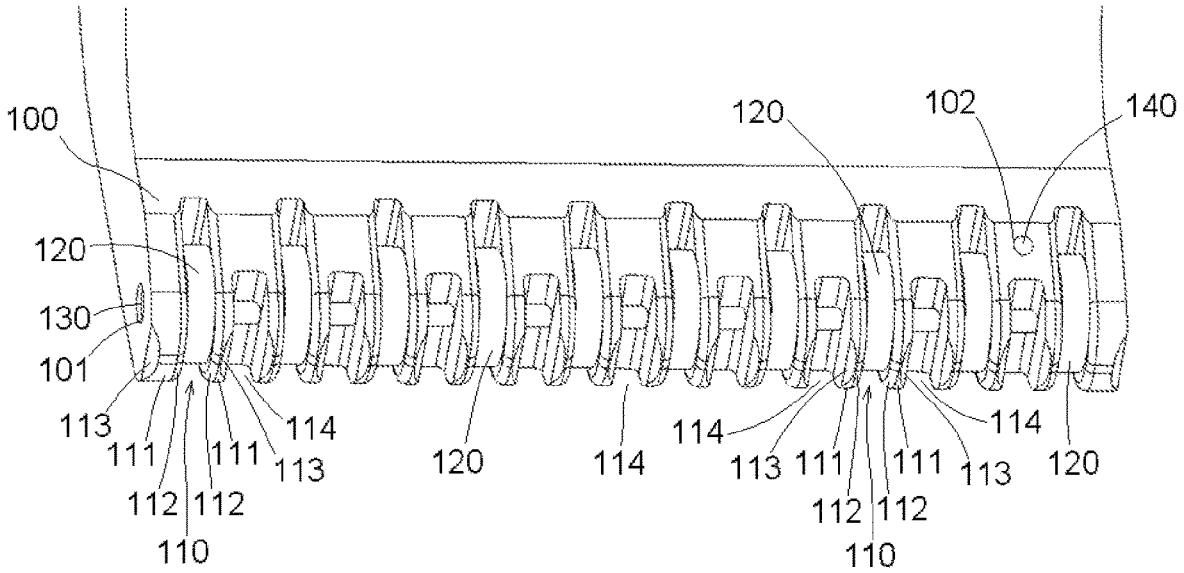
FIG. 2 is an enlarged perspective view of the terminal bending tool.
Figure 3:
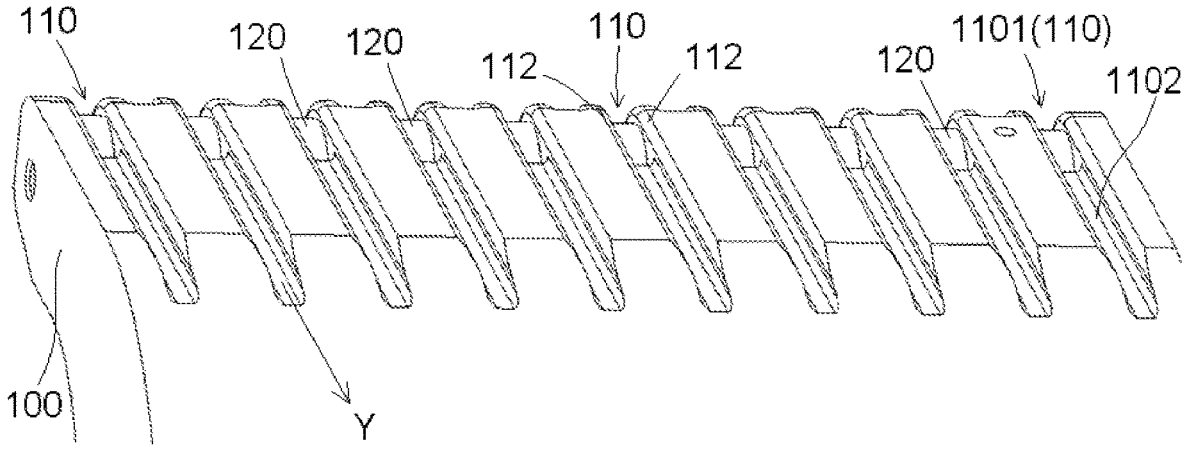
FIG. 3 is a bottom view of the terminal bending tool.

The plate 100, as shown in FIGS. 1-4, extends in a first horizontal direction X. The receiving grooves 110 are disposed in the plate 100 in a row along the first horizontal direction X so that the plate 100 is comb-shaped. Each receiving groove 110, as shown in FIG. 3, has a forepart 1101 at an edge of the plate 100 of the terminal bending tool 10 and a bottom part 1102 on a bottom of the plate 100 of the terminal bending tool 10. The forepart 1101 of the receiving groove 100 passes through the plate 100 in a vertical direction Z. The bottom part 1102 of the receiving groove 110 extends a predetermined length in a second horizontal direction Y perpendicular to the first horizontal direction X and the vertical direction Z.

A plurality of partition walls 111 of the plate 100, as shown in FIG. 2, separate the receiving grooves 110. A slanted first guiding surface 112 is formed on each partition wall 111 at a first side thereof facing each receiving groove 110. A slanted second guiding surface 113 is formed on each partition wall 111 at an opposite second side thereof. A channel 114 is formed in the plate 100 between two adjacent receiving grooves 110, and the channel 114 and the receiving groove 110 are partitioned by the partition wall 111. The receiving grooves 110 and the channels 114 are disposed alternating along the length of the first horizontal direction X.

Figure 4:
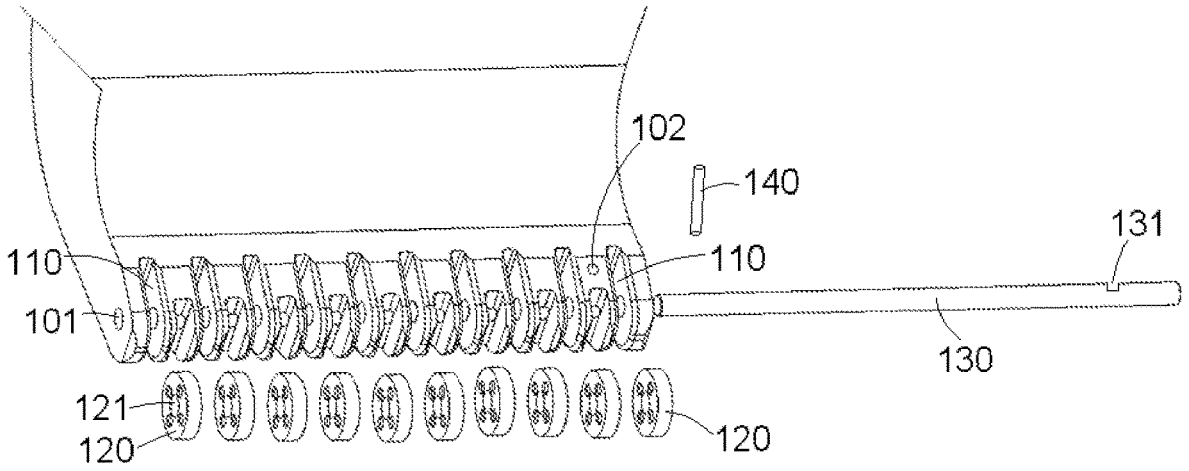
FIG. 4 is an exploded view of the terminal bending tool.

The rollers 120, as shown in FIGS. 1-4, are circular members pivotally mounted in the receiving grooves 110. Each roller 120 is mounted on the forepart 1101 of the receiving groove 110. The rollers 120, as shown in FIG. 4, are pivotally mounted in respective receiving grooves 110 through a single pivot shaft 130 mounted on the plate 100. The pivot shaft 130 is inserted through a mounting hole 101 formed in the plate 100 in the first horizontal direction X and passes through center mounting holes 121 formed in the rollers 120.

The pivot shaft 130, as shown in FIGS. 2 and 4, is mounted on the plate 100 by a positioning pin 140 inserted in the plate 100. A vertical insertion hole 102 is formed in the plate 100 and a notch 131 is formed in the outer periphery of the pivot shaft 130, the positioning pin 140 is inserted into the insertion hole 102 and is held in the notch 131 of the pivot shaft 130, thereby fixing the pivot shaft 130 onto the plate 100.

As shown in FIG. 1, the transition portion 200 is a curved member connected with the plate 100. The mounting portion 300 is a flat member connected with the transition portion 200 such that the terminal bending tool 10 is formed in an L-shape. In the embodiment shown in FIG. 1, a mounting hole 310 is formed in the mounting portion 300.

The terminal bending tool 10 is used to bend a plurality of terminals 21, as will be described with reference to FIGS. 5-8. The terminals 21, as shown in FIGS. 5 and 6, are disposed in terminal holding grooves 22 of a connector casing 20.

Figure 5:
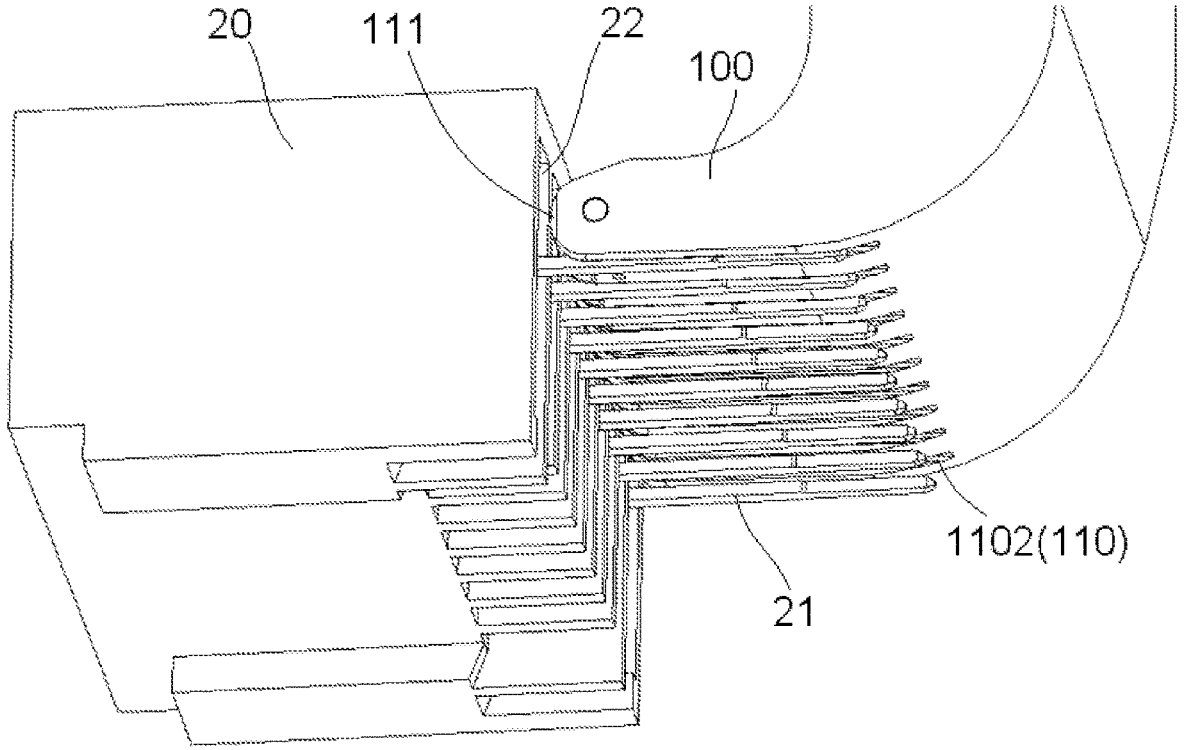
FIG. 5 is a perspective view of the terminal bending tool and a plurality of terminals prior to bending.
Figure 6:
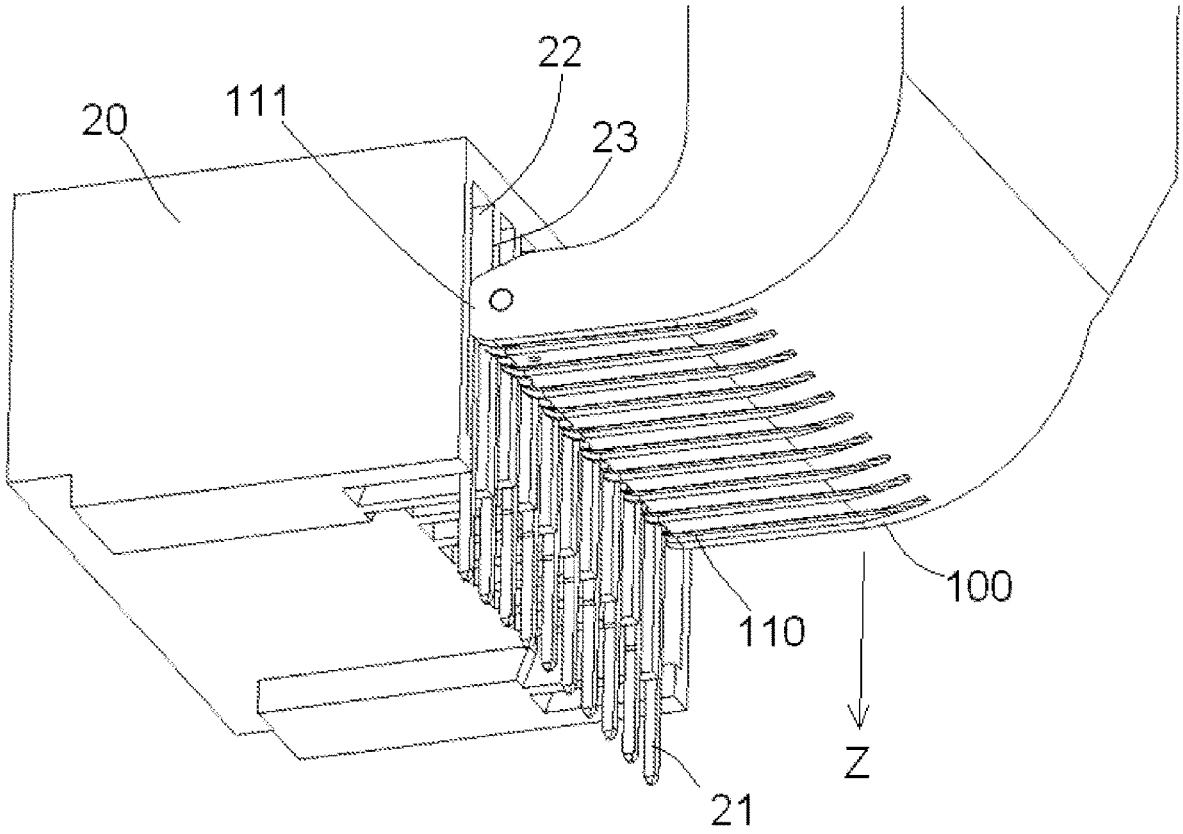
FIG. 6 is a perspective view of the terminal bending tool and the plurality of terminals after bending.
Figure 7:
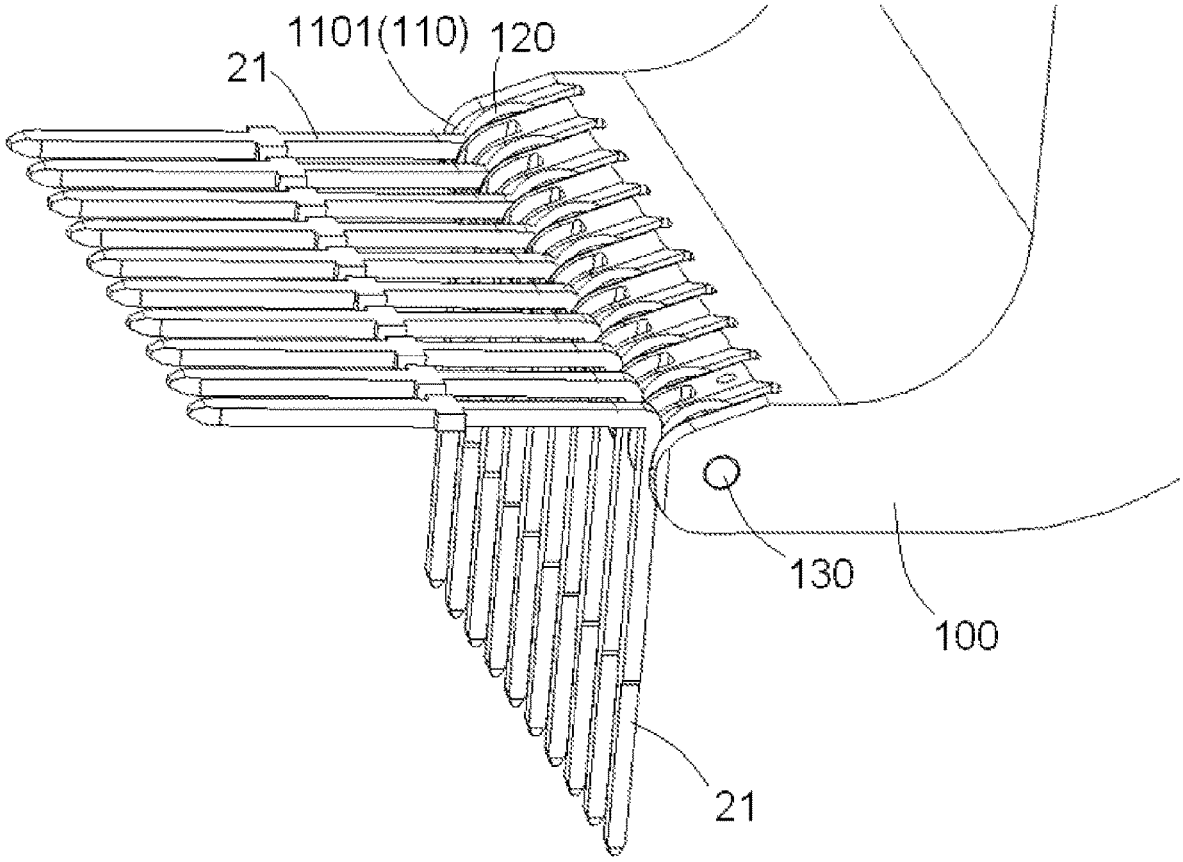
FIG. 7 is another perspective view of the terminal bending tool and the plurality of terminals after bending.

As shown in FIGS. 5-7, the terminals 21 to be bent, which are disposed along the first horizontal direction X, are received and positioned in the receiving grooves 110. Each first guiding surface 112 guides the terminal 21 to be bent into the receiving groove 110 smoothly. A part of the terminal 21 which is to be bent is totally received and positioned in the bottom part 1102 of the receiving groove 110, as shown in FIG. 5. A connector partition 23 between two adjacent terminal holding grooves 22 of the connector casing 20, shown in FIG. 6, is partly received in one corresponding channel 114. The second guiding surface 113 guides the partition wall 111 into a corresponding terminal holding groove 22 smoothly.

The terminals 21 are in physical contact with outer circumferential surfaces of the rollers 120 in the receiving grooves 110, respectively. As shown in FIGS. 6 and 7, when the terminal bending tool 10 is moved in a vertical direction Z perpendicular to the first horizontal direction X, the terminals 21 received in the receiving grooves 110 are bent under pushing and pressing of the rollers 120. During bending of the terminals 21, the rollers 120 are rotated, such that the roller 120 is moved in a rolling manner with respect to the surface of the terminal 21. As shown in FIGS. 6 and 7, a part of the terminal 21 which has been bent is received and positioned in the forepart 1101 of the receiving groove 110 after the terminal 21 is bent.

Figure 8A:
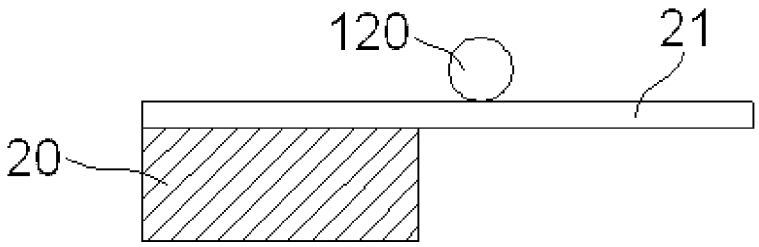
FIG. 8A is a side view of a roller of the terminal bending tool and a terminal of the plurality of terminals prior to bending.
Figure 8B:
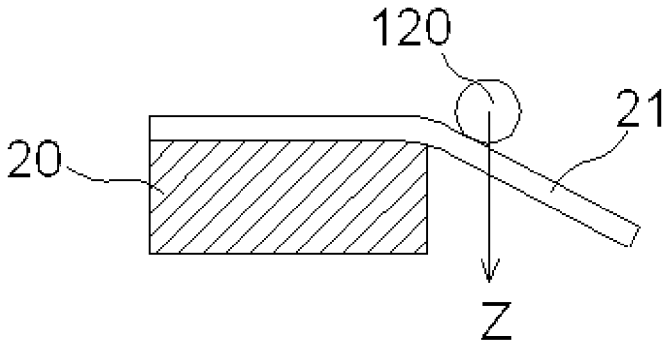
FIG. 8B is a side view of the roller and the terminal during bending.
Figure 8C:
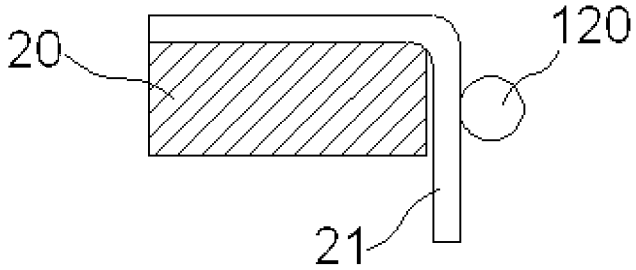
FIG. 8C is a side view of the roller and the terminal after bending.

An operation of bending the terminals 21 with the rollers 120 is shown schematically in FIGS. 8A, 8B, and 8C. As shown in FIG. 8A, when the terminals 21 are initially bent, the rollers 120 are positioned above the terminals 21 and are pressed against upper surfaces of the terminals 21. As shown in FIG. 8B, when the rollers 120 are moved downward by a distance in the vertical direction Z, the terminals 21 are bent by an angle under the pressing of the rollers 120. As shown in FIG. 8C, when the roller 120 continues to move down to a predetermined position in the vertical direction Z, the terminals 21 are bent by 90 degrees under the pressing of the rollers 120, thereby completing the bending of the terminals 21.

In an embodiment, the mounting portion 300 is mounted on a moving mechanism (not shown) such as a X-Y-Z three axes translation mechanism via a threaded connector passing through the mounting hole 310. The moving mechanism drives the terminal bending tool 10 to move in the vertical direction Z to bend the terminals 21.

The terminals 21 are pressed by the rollers 120, and because the rollers 120 each have a smooth outer circumferential surface rotating relative to the surfaces of the terminals 21, the surface of each terminal 120 in contact with the roller 120 will not be scratched, ensuring the surface quality of the folded terminals 21. In addition, during the bending, the terminals 21 are positioned in the corresponding receiving grooves 110 of the terminal bending tool 10, and there will not be any positional offsets, ensuring the positional accuracy of the bent terminals 21. The terminal bending tool 10 is adapted to bend a row of terminals 21 simultaneously and improve bending efficiency.

In the embodiment shown in FIGS. 1-7, the quantity of terminals 21 is equivalent to the quantity of receiving grooves 110; each terminal 20 corresponds to one receiving groove 110. However, the quantity of terminals 21 may be less than the quantity of receiving grooves 110. The terminal bending tool 10 may also be used for bending only a single terminal 21 at a time.

What is claimed is:

1. A terminal bending tool, comprising:

a plate extending in a horizontal direction and having a mounting hole and a plurality of receiving grooves in a row extending along the horizontal direction;

a pivot shaft extending in the horizontal direction through the mounting hole in the plate;

a positioning pin in the plate fixing the pivot shaft to the plate;

a plurality of rollers, each having a center mounting hole through which the pivot shaft extends in the horizontal direction to pivotally mount the rollers to the pivot shaft and in the receiving grooves; and a terminal in a first receiving groove of the receiving grooves and in contact with an outer circumferential surface of a first roller of the rollers, such that when the terminal bending tool is moved in a vertical direction perpendicular to the horizontal direction, the first roller rotates and moves along a surface of the terminal while pressing and bending the terminal.

2. The terminal bending tool of claim 1, wherein a plurality of terminals are disposed along the first horizontal direction and are positioned in the receiving grooves.

3. The terminal bending tool of claim 2, wherein the terminals are simultaneously bent by the rollers when the terminal bending tool is moved in the vertical direction.

4. The terminal bending tool of claim 3, wherein a quantity of the terminals is less than or equal to a quantity of the receiving grooves.

5. The terminal bending tool of claim 3, wherein the plate has a partition wall adjacent each receiving groove.

6. The terminal bending tool of claim 5, wherein the partition wall has a slanted first guiding surface at a first side of the partition wall facing the receiving groove.

7. The terminal bending tool of claim 6, further comprising a plurality of channels disposed in the plate, each channel disposed between a pair of adjacent receiving grooves and the channels and receiving grooves disposed alternating along the horizontal direction.

8. The terminal bending tool of claim 7:

(a) further including a connector casing having a plurality of terminal holding grooves separated by a plurality of connector partitions, and (b) wherein the terminals are disposed in the connector casing.

9. The terminal bending tool of claim 8, wherein the connector partitions are in the channels during bending of the terminals.

10. The terminal bending tool of claim 6, wherein the partition wall has a slanted second guiding surface at an opposite second side of the partition wall.

11. The terminal bending tool of claim 1, wherein:

(a) the plate has a vertical insertion hole, (b) an outer periphery of the pivot shaft has a notch, and (c) the positioning pin is inserted into the vertical insertion hole and held in the notch.

12. A terminal bending tool, comprising:

a plate extending in a first horizontal direction and having a plurality of receiving grooves disposed in the plate in a row along the first horizontal direction with each receiving groove having:

(a) a forepart at an edge of the plate extending through the plate in the vertical direction and (b) a bottom part on a bottom of the plate, extending a predetermined length in a second horizontal direction perpendicular to the first horizontal direction and the vertical direction; and a plurality of rollers pivotally mounted in the receiving grooves; and a terminal in a first receiving groove of the receiving grooves and in contact with an outer circumferential surface of a first roller of the rollers, such that when the terminal bending tool is moved in a vertical direction perpendicular to the first horizontal direction, the first roller rotates and moves along a surface of the terminal while pressing and bending the terminal.

13. The terminal bending tool of claim 12, wherein the first roller is mounted in the forepart of the first receiving groove.

14. The terminal bending tool of claim 13, wherein a portion of the terminal is received and positioned in the bottom part of the first receiving groove before the terminal is bent.

15. The terminal bending tool of claim 14, wherein the portion of the terminal is received and positioned in the forepart of the first receiving groove after the terminal is bent.

16. A terminal bending tool, comprising:

a plate extending in a first horizontal direction;

a plurality of receiving grooves disposed in the plate in a row along the first horizontal direction;

a plurality of rollers pivotally mounted in the receiving grooves, a terminal received and positioned in a first receiving groove of the receiving grooves and in contact with an outer circumferential surface of a first roller of the rollers, such that when the terminal bending tool is moved in a vertical direction perpendicular to the first horizontal direction, the first roller rotates and moves along a surface of the terminal while pressing and bending the terminal;

a curved transition portion connected with the plate; and a mounting portion connected with the curved transition portion, the terminal bending tool formed in an L-shape.

17. The terminal bending tool of claim 16, wherein the mounting portion has a mounting hole mounted on a moving mechanism, the moving mechanism driving the terminal bending tool to move in the vertical direction.

* * * * *